US005514948A

United States Patent [19]

Okazaki

[11] Patent Number: 5,514,948

[45] Date of Patent: May 7, 1996

[54] REFERENCE VOLTAGE GENERATING CIRCUIT

[75] Inventor: Takao Okazaki, Tokyo, Japan

[73] Assignee: Hitachi, Ltd., Tokyo, Japan

[21] Appl. No.: 114,354

[22] Filed: Sep. 1, 1993

[30] Foreign Application Priority Data

Sep. 2, 1992 [JP] Japan ..... 4-258979

[51] Int. Cl.[6] ..... G05F 3/16

[52] U.S. Cl. ..... 323/314; 323/907; 327/539; 327/541

[58] Field of Search ..... 323/312, 313, 323/314, 407; 327/538, 539, 540, 541

[56] References Cited

U.S. PATENT DOCUMENTS 4,814,686 3/1989 Watanabe ..... 323/313

FOREIGN PATENT DOCUMENTS 2090442 7/1982 United Kingdom ..... 323/313

2105072 3/1983 United Kingdom ..... 323/313

*Primary Examiner*—Jeffrey L. Sterrett

*Attorney, Agent, or Firm*—Antonelli, Terry, Stout & Kraus

[57] ABSTRACT

A constant current is produced by a first MOSFET of depletion type whose source and gate are interconnected and then is passed through a current mirror circuit made up of MOSFETs of the opposite conduction type with respect to the first MOSFET and to a second MOSFET which has the same conduction type as the first MOSFET and whose gate and drain are interconnected. The voltage between the gate and the source of the second MOSFET is taken as an output constant voltage, which is temperature-compensated by the current ratio of the current mirror circuit.

10 Claims, 4 Drawing Sheets

REFERENCE VOLTAGE GENERATING CIRCUIT

BACKGROUND OF THE INVENTION

The present invention relates to a reference voltage generating circuit, and, more particularly, to a technique effectively applied to a reference voltage generating circuit built into a semiconductor integrated circuit device that permits operation down to such low voltages as battery voltages.

A reference voltage generating circuit such as shown in FIG. 8 using MOSFETs (insulated-gate field-effect transistors) is available. This circuit includes n-channel MOSFETs Q3, Q4, Q5 with low threshold voltages and a MOSFET Q6 with a standard threshold voltage and derives the difference between the threshold voltages of MOSFETs Q5 and Q6 as a reference voltage Vr. For temperature compensation, p-channel MOSFETs Q1 and Q2 form a current mirror circuit, whose current ratio is set at an appropriate value. Another example of such a reference voltage generating circuit is found in the Japanese Patent Laid-Open No. 249212/1987.

SUMMARY OF THE INVENTION

In the circuit of FIG. 8, when an n-type substrate is used and an n-channel MOSFET is to be formed in a p-type well area, the source of the n-channel MOSFET and the substrate gate (well area) maybe short-circuited to prevent the occurrence of $\Delta$Vth that could result from the substrate bias effect. However, when a p-type substrate is used, the threshold voltage Vth at the MOSFET Q5 will increase by $\Delta$Vth because of the substrate effect. Upon occurrence of such a substrate effect, the temperature characteristic produced by $\Delta$Vth makes temperature compensation virtually impossible.

Another problem of the circuit of FIG. 8 is that because the actual semiconductor manufacturing technique introduces n-type impurities such as arsenic (As) into the substrate gate by ion implantation, the MOSFETs Q3–Q5 have threshold voltages lower than that of the MOSFET Q6, which has a standard threshold voltage. This means that the temperature coefficients of the channel conductances will differ although these MOSFETs Q3–Q5 and Q6 are the same n-channel MOSFETs, making it impossible to perform satisfactory temperature compensation by the above-mentioned current ratio alone.

Still another problem of the circuit of FIG. 8 is that the virtual lower-limit operation voltage becomes relatively large. For example, in electronic equipment driven by a battery such as nickel-cadmium battery, the voltage of the nickel-cadmium battery can reduce from 3.6 V to about 2.7 V because of power consumption. The circuit shown in FIG. 8, when actually used, is provided with a MOSFET for regulating the power supply to reduce the power supply voltage dependency (PSRR). The insertion of the additional MOSFET increases the lower-limit operation voltage to about 4 V, making low voltage battery-driven operation impossible.

A further problem of the circuit shown in FIG. 8 is that the current mirror circuit provides a current feedback, so that the reference voltage generating circuit requires a starting circuit. It is relatively difficult to make a circuit that can start a circuit having such a feedback loop L reliably and stably. This in turn increases the number of circuit elements.

These problems have been found during research by the inventor.

An object of this invention is to provide a reference voltage generating circuit that is simple in construction and able to produce a temperature-compensated reference voltage.

Another object of this invention is to provide a reference voltage generating circuit that has improved stability in operation and can operate down to low voltages.

Still another object of this invention is to provide a reference voltage generating circuit that can produce a desired reference voltage without being influenced by process variations.

These and other objects and novel features of this invention will become apparent from the description that follows in this specification and the accompanying drawings.

A representative aspect of this invention may be briefly summarized as follows. A constant current is formed by a first MOSFET of depletion type with its source and gate connected and is passed through a current mirror circuit formed by MOSFETs of opposite conduction type with respect to the first MOSFET. The constant current is then supplied to a second MOSFET of the same conduction type as the first MOSFET with its gate and drain connected to provide the voltage between its gate and source as an output constant voltage, while at the same time the output constant voltage is temperature-compensated by the current ratio of the current mirror circuit.

With the above means, the temperature-compensated reference voltage can be obtained by a very simple circuit, which comprises a depletion type MOSFET, an enhancement type MOSFET of the same conduction type as the depletion type MOSFET, and a pair of MOSFETs making up the current mirror circuit.

DESCRIPTION OF THE PREFERRED EMBODIMENT

Figure 1:
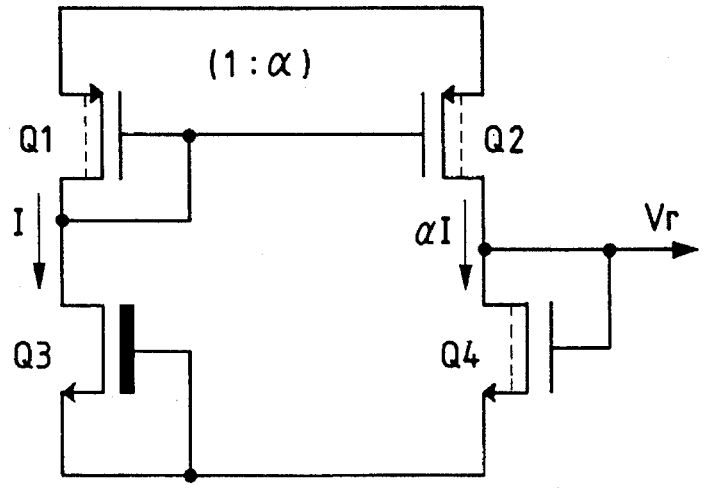
FIG. 1 is a fundamental circuitry of one embodiment of the reference voltage generating circuit according to the present invention.

FIG. 1 shows a basic circuit of the reference voltage generating circuit as one embodiment of this invention. The circuit elements in the figure are formed on a single semiconductor substrate such as a monocrystal silicon by a known semiconductor integrated circuit manufacturing technique along with other circuit elements that require reference voltages.

The depletion type MOSFET Q3 has its gate and source interconnected to act as a constant current source. The gate and source of the MOSFET Q3 are connected to a power supply line on the low voltage side such as a circuit's grounding potential. The constant current I obtained at the drain of the MOSFET Q3 is supplied to a current mirror circuit made up of p-channel MOSFETs Q1 and Q2. The p-channel MOSFET Q1 has its gate and drain interconnected to act as a diode. The MOSFET Q2 has its gate and source connected to the corresponding gate and source of the MOSFET Q1 and produces a current αI at the drain that is proportional to the size ratio. The sources of the MOSFETs Q1 and Q2 of the current mirror circuit may, for example, be connected to a power supply line on the higher voltage side.

An enhancement type MOSFET Q4, like the depletion type MOSFET Q3, is formed as a p-channel MOSFET. The gate and drain of the MOSFET Q4 are diode-configured, and the voltage between the gate and the source is output as a reference voltage Vr. The source of the MOSFET Q4 may, for example, be connected to a power supply line on the lower voltage side such as the circuit's grounding potential as in the case of the MOSFET Q3.

In this embodiment the MOSFET Q4 and the MOSFETs Q1 and Q2 forming the current mirror circuit are provided with low threshold voltages. In the diagram those MOSFETs marked with a dashed line in the channel region represent MOSFETs having low threshold voltages. The MOSFET marked with a thick gate represent a MOSFET of a depletion type.

Figure 2:
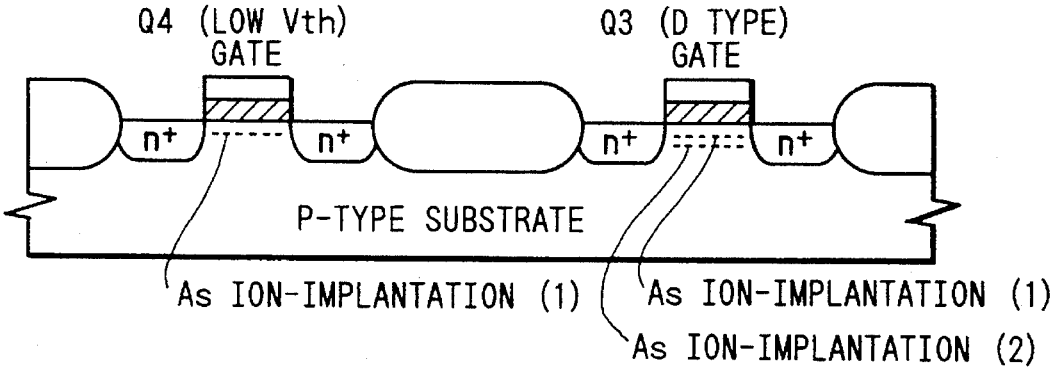
FIG. 2 is a cross section showing the outline structure of the MOSFETs Q3 and Q4 of FIG. 1.

FIG. 2 is a cross section showing an example outline structure of circuit elements MOSFETs Q3 and Q4. In this embodiment, the semiconductor substrate used is of a p-type. On this p-type substrate, a field insulating film and a thin gate insulating film are formed in that order by the ordinary manufacturing process. With gate electrodes formed on these films used as a mask, sources and drains of $n^+$ are diffused to form MOSFETs with ordinary threshold voltages.

Then, an n-type impurity As is first introduced from above the gate electrodes of the MOSFETs Q3 and Q4 into the surface of the semiconductor substrate (channel region) by an ion-implantation technique. This first-time introduction of impurity causes both of the MOSFETs Q3 and Q4 to have low threshold voltages. After this, the n-type impurity As is introduced for the second time from above the gate electrode of the MOSFET Q3 into the surface of the semiconductor substrate (channel region) by an ion-implantation technique. This introduction of impurity causes the MOSFET Q3 to change from the enhancement type with a low threshold voltage to the depletion type with a negative threshold voltage.

Figure 3:
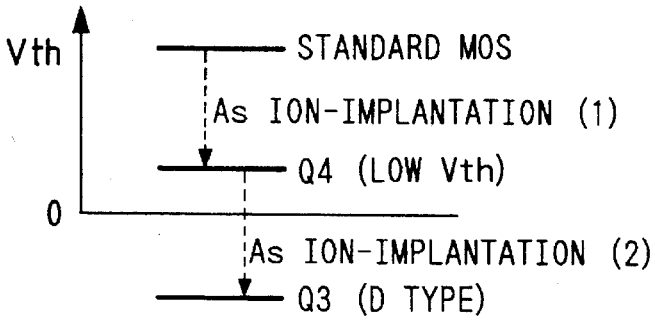
FIG. 3 is a conceptual diagram showing the threshold voltages of the MOSFETs Q3 and Q4 of FIG. 2.

Since, as shown in FIG. 3, the first impurity introduction process by the common ion-implantation (As ion-implantation (1)) causes both MOSFETs Q3 and Q4 to change their threshold voltages from the standard threshold voltages (which they had when not implanted with impurity) to the lower threshold voltages, and the second impurity introduction process for the MOSFET Q3 (As ion-implantation (2)) causes the threshold voltage of the MOSFET Q3 to change from the low threshold voltage to the negative threshold voltage, variations of the difference between the threshold voltages of the MOSFETs Q4 and Q3 during manufacture process can be minimized. In other words, the difference between the threshold voltages of MOSFETs Q4 and Q3 can be made a relatively small value which depends on the amount of impurity introduced by the second ion-implantation.

That is, if the MOSFETs Q4 and Q3 with standard threshold voltages are separately implanted with impurities in individual processes, it is necessary to consider worst-case process variations in the threshold voltages for both of the MOSFET Q4 and the MOSFET Q3.

The reference voltage Vr produced by the circuit of FIG. 1 is temperature-compensated as follows.

The constant current I produced by the MOSFET Q3 and the constant current αI flowing into the MOSFET Q4 can be determined by equations (1) and (2):

$$I=\beta 3/2(-Vth3)^2 \quad (1)$$

$$\alpha I=\beta 4/2(Vr-Vth4)^2 \quad (2)$$

From equations (1) and (2), equation (3) is obtained.

$$\alpha\beta 3/2(-Vth3)^2=\beta 4/2(Vr-Vth4)^2 \quad (3)$$

If we let the channel conductances of the MOSFETs Q3 and Q4, which are both n-channel MOSFETs, be β3=β4, then the equations (3) and (4) can be rewritten as:

$$\alpha^{1/2}Vth3=Vr-Vth4 \quad (4)$$

In this equation (4), Vth3 takes a negative value but is shown as an absolute value. From this equation (4), equation (5) can be derived to determine the reference voltage Vr.

$$Vr=Vth4-\alpha^{1/2}Vth3 \quad (5)$$

To make the temperature dependency dVr/dT of the reference voltage Vr zero, α may be set as indicated by equation (6):

$$\alpha^{1/2}=(dVth4/dT)/(dVth3/dT) \quad (6)$$

The temperature coefficients of the channel conductances β3 and β4 of the MOSFETs Q3 and Q4 are considered to vary depending not only on the amount of channel impurities but also the kinds of the impurities. Because the temperature characteristic of the channel conductance does not change linearly with the temperature T, simultaneous ion-implanting of As into both the MOSFETs Q3 and Q4 to set the channel impurity concentrations as in the above embodiment enables the temperature characteristics of β3 and β4 to be almost equal.

Since the threshold voltages Vth3 and Vth4 change linearly with temperature T, it is possible to set the threshold voltages at values that virtually pose no problems, by setting a certain constant current mirror ratio α from equation (6).

Experience shows that the appropriate value of α is close to unity. Hence, from equation (5), the reference voltage Vr is a voltage close to the difference between the threshold voltages Vth4 and Vth3. It means that the reference voltage Vr depends on the variations of Vth4-Vth3. For this reason, as in the embodiment of FIG. 2, the ion implantation is divided in two processes. At the first implantation the MOSFETs Q3 and Q4 are both made to have low threshold voltages and at the second implantation the MOSFET Q3 is formed into a depletion type, thus limiting the process variations to a small value corresponding to the amount of impurity introduced by the second ion-implantation.

In the circuit of FIG. 1, the constant current is produced by using the depletion type MOSFET Q3. Circuits using such a depletion type MOSFET Q3 require no special starting circuit and have no feedback loop L which would exist in the conventional circuits, eliminating the possibility of abnormal operation such as oscillation. By setting the current mirror circuit also at the lower threshold voltages, the lower-limit operation voltage can be reduced substantially. For instance, if the threshold voltage of the MOSFET Q4 is set to 0.3 V, that of the MOSFET Q3 to −0.4 V, and those of the MOSFETs Q1 and Q2 to about −0.3 V, the lower-limit operation voltage can be as low as 1 V or less. If the MOSFETs Q1 and Q2 have the standard threshold voltages of about −0.9 V, the lower-limit operation voltage will be about 2.5 V.

Figure 4:
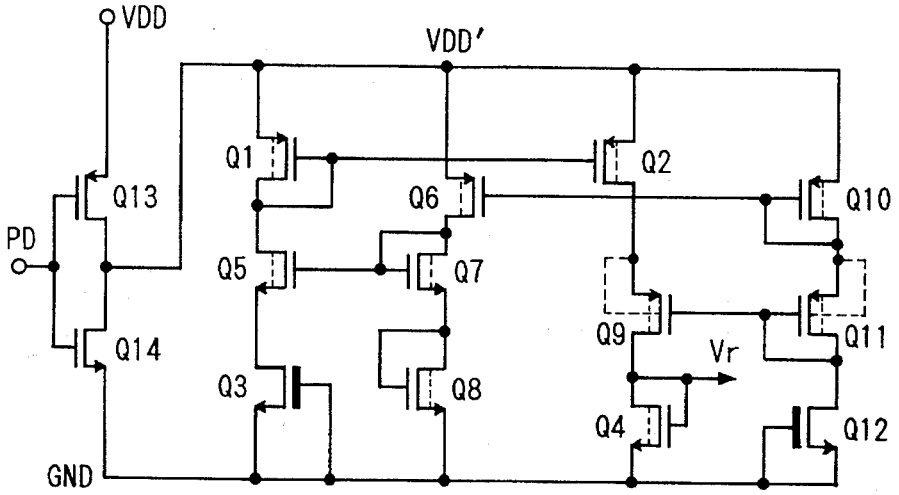
FIG. 4 is a reference voltage generating circuit as one embodiment of this invention.

FIG. 4 shows a circuit of another embodiment of the reference voltage generating circuit according to the present invention. In this embodiment, power is supplied through a CMOS invertor circuit made up of a p-channel MOSFET Q13 and an n-channel MOSFET Q14, both with standard threshold voltages, for reducing power consumption. That is, when the power-down signal PD input to the CMOS invertor circuit is low, the p-channel MOSFET Q13 of the CMOS invertor circuit turns on to supply a power supply voltage VDD to the power supply line VDD' in the reference voltage generating circuit. When the power-down signal PD is high, the n-channel MOSFET Q14 turns on to supply the ground potential and thereby stop the power supply to the reference voltage generating circuit, so that no operation current flows.

In this embodiment, to reduce the power supply voltage removal ratio PSRR, the depletion type MOSFET Q3 is made to keep its drain voltage constant. That is, an n-channel MOSFET Q5 is inserted between the constant current MOSFET Q3 and the current mirror MOSFET Q1. The MOSFET Q5 receives at its gate a constant voltage (2Vth) formed by a series circuit of diode-configured n-channel MOSFETs Q7 and Q8. These MOSFETs Q7 and Q8 are provided with low threshold voltages so as to set the lower-limit operation voltage as low as possible. The constant voltage is based on the circuit's ground potential GND and remains almost constant irrespective of variations of the supply voltage (VDD) (VDD'). For instance, as the drain voltage of the MOSFET Q5 increases in response to variations of the power supply voltage VDD, the current will increase causing the drain voltage of the MOSFET Q3 to rise. However, because the gate voltage of the MOSFET Q5 is constant, the conductance of the MOSFET Q5 becomes small, reducing the current to maintain the drain voltage of the MOSFET Q3 almost constant.

Between the drain of the MOSFET Q4 forming the reference voltage Vr and the current mirror MOSFET Q2 is provided a p-channel MOSFET Q9, whose gate is supplied with a constant voltage (2Vth) formed by a series circuit of diode-configured p-channel MOSFETs Q10 and Q11. These MOSFETs Q10 and Q11 have low threshold voltages to permit setting of as low a lower-limit operation voltage as possible. The constant voltage is based on the power supply voltage VDD (VDD') and assumes a voltage corresponding to the variations of the power supply voltage VDD, maintaining the drain voltage of the MOSFET Q4 almost constant and significantly improving the PSRR.

The depletion type MOSFET Q12 forms a constant current. The constant current produced by the MOSFET Q12 is passed through the MOSFETs Q11 and Q10. The MOSFET Q6 connected in series with the MOSFET Q8 and Q7 is current-mirror configured with the MOSFET Q10 so that the same constant current will also flow through these MOSFETs Q7 and Q8.

In the embodiment of FIG. 1 or FIG. 4, if the MOSFET Q4 is used in a long channel, the variation of its threshold voltage Vth of 0.3 V is about ±0.1 V. If the MOSFET Q3 is formed into the depletion type based on the threshold voltage of the MOSFET Q4 by the second ion-implantation, the variation of the threshold voltage caused by the ion-implantation is about ±0.05 V. Hence, the overall process variation of the threshold voltage Vth3 of the MOSFET Q3 will be around ±0.15 V.

Because the variation of the threshold voltage Vth3 in the temperature range of −40° C. to 90° C. is about ±0.1 V, the actual variation of the threshold voltage Vth3 of the MOSFET Q3 will be about ±0.25 V in total. Therefore, the actual threshold voltage Vth3' of the MOSFET Q3 can be expressed as Vth3'= Vth3 ±0.25 V where Vth3 is a design value.

From equation (1), the constant current I is determined by the actual threshold voltage Vth3' of the MOSFET Q3. If the absolute value of the threshold voltage Vth3' is small, the constant current becomes unstable. The absolute value therefore must be at least 0.1 V. This means that the design value of the threshold voltage of the MOSFET Q3 needs to be set at −0.35 V at the minimum.

Considering the configuration of a trimming circuit explained below, the reference voltage Vr is preferably set at about 0.7 V. From equation (5), the threshold voltage Vth3 (design value) of the MOSFET Q3 is set at around −0.4 V.

Figure 5:
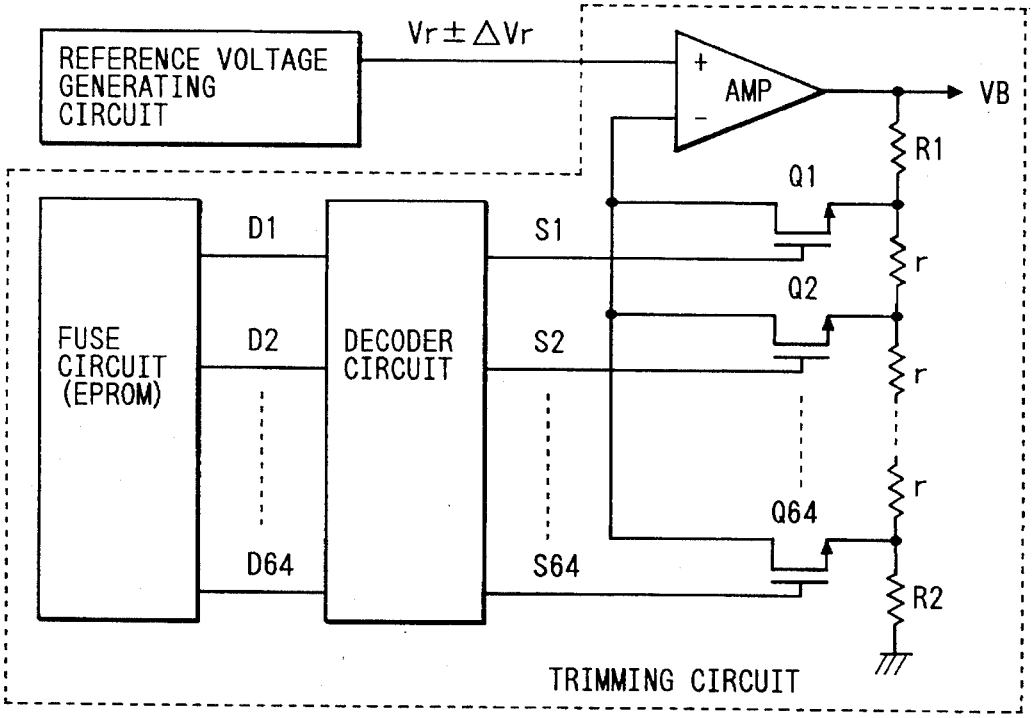
FIG. 5 is an example embodiment of a trimming circuit used in the reference voltage generating circuit according to this invention.

FIG. 5 shows an example circuit configuration of a trimming circuit used in the reference voltage generating circuit of this invention. Since the reference voltage Vr obtained is only a particular voltage that depends on the semiconductor process and has process variations, the following trimming circuit is employed to compensate for the process variations to form a desired reference voltage.

The voltage formed by the reference voltage generating circuit contains process variations such as Vr±ΔVr, whereas the reference voltage VB required by general semiconductor integrated circuits must have a specific voltage value. To meet this requirement the following trimming circuit is provided.

An operational amplifier circuit AMP is provided with a resistor circuit between its inverted input (−) and output for setting a gain. The resistor circuit comprises a fixed resistor R1 inserted between the output terminal and the ground potential of the operational amplifier circuit AMP, adjust resistors r for trimming, and a fixed resistor R2. Between the joints of the series resistors and the inverted input (−) of the operational amplifier circuit AMP are connected switch MOSFETs Q1–Q64. One of the switch MOSFETs Q1–Q64 turns on to divide the series resistor circuit in two and connect the divided resistor circuit to the inverted input (−). By setting a desired resistor ratio in this way, an appropriate gain of the operational amplifier circuit AMP is set, providing the reference voltage VB of a desired voltage value.

When, for example, n ($=2^k$) switch MOSFETs are used, the adjust resistors r number n−1 and the gain Gj when a j-th switch from the top is turned on is determined from equation (7):

$$Gj=[R1+R2+(n-1)r]/[R2+(n-j)r] \quad (7)$$

Therefore, when Vr changes by ΔVr, the j-th switch MOSFET determined by equation (8) need only be selected to pick up a voltage very close to the desired voltage VB.

$$Gj\neq VB/(Vr+\Delta Vr) \quad (8)$$

In the above embodiment the switch MOSFETs number 64, for example. Hence, there are 63 adjust resistors r and a 6-bit trimming signal D1–D6 is required. A fuse circuit during the probing process measures the voltage Vr±ΔVr formed by the reference voltage generating circuit, calculates a gain necessary to produce a desired constant voltage VB and, according to the calculated gain, specifies one of 64 combinations of states of six fuses. A decoder circuit decodes the 6-bit signal D1–D6 and causes one of 64 switch signals S1–S64 to go high to turn on the corresponding switch MOSFET. In this way, a reference voltage VB required by the semiconductor integrated circuit described later is formed.

Figure 7:
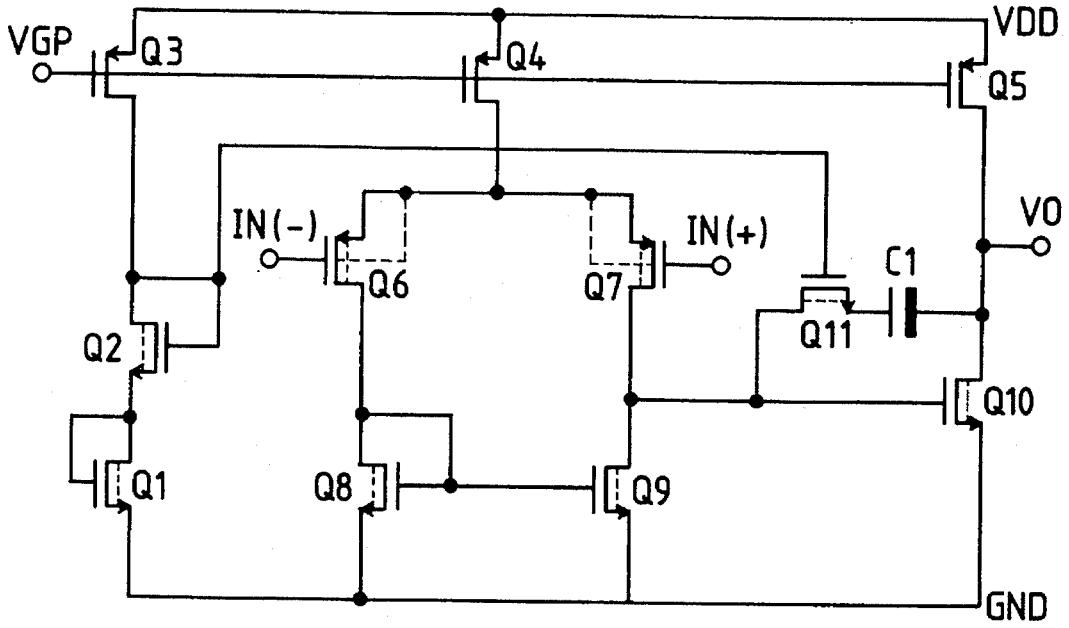
FIG. 7 is circuitry showing one embodiment of an operational amplifier circuit used in the trimming circuit of FIG. 5.
Figure 8:
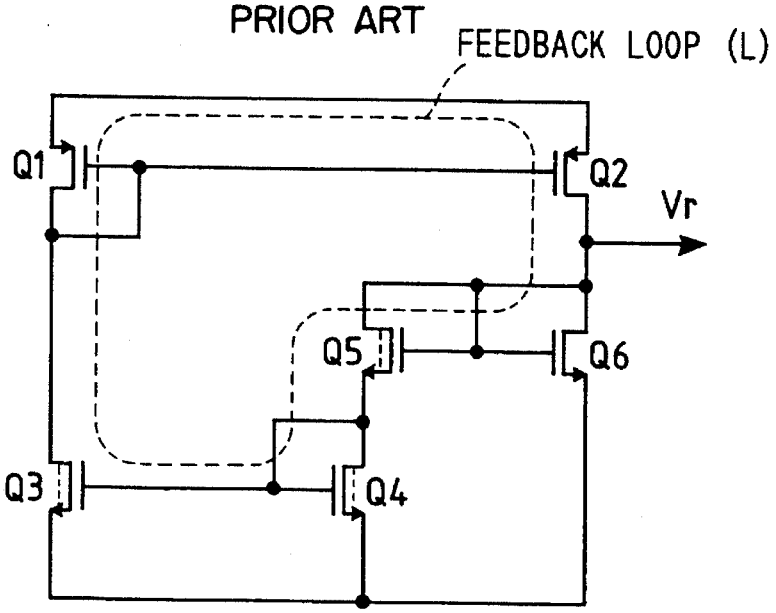
FIG. 8 PRIOR ART
FIG. 8 is circuitry showing one example of a conventional reference voltage generating circuit.

FIG. 7 shows an example circuit of the operational amplifier circuit AMP.

In this example, p-channel MOSFETs Q6 and Q7 with low threshold voltages are used as amplification MOSFETs in a differential stage, and n-channel MOSFETs Q8, Q9 of current mirror configuration provided at the drains of the p-channel MOSFETs Q6, Q7 as well as an n-channel MOSFET Q10 at the output stage are also set with low threshold voltages. This allows the common mode input voltage range (CMIVR) to be increased. A MOSFET Q11 and a capacitor C1 form a phase compensation circuit inserted between the input and output of the output stage MOSFET Q10. Because the circuits are formed using a p-channel substrate, as described earlier, the differential amplification p-channel MOSFETs Q6 and Q7 are formed in an n-type well region. Therefore, the substrate gate (channel region) and the source are commonly formed to eliminate the substrate effect. This also applies to the p-channel MOSFETs Q9 and Q11 in FIG. 4.

While the p-channel and n-channel MOSFETs with low threshold voltages are necessary for preventing deterioration of analog circuits' characteristics, they have a problem of leaking a current even when they are turned off, making the leak current detection in the semiconductor IC circuit impossible.

In this embodiment, the MOSFETs Q3 and Q4 for flowing a bias current and a constant current load MOSFET Q5 are set with standard threshold voltages. The gates of the MOSFETs Q3, Q4 and Q5 are supplied with a constant bias voltage VGP to produce corresponding currents at the differential stage and the output stage.

When the bias voltage VGP is set to a high level such as a supply voltage VDD, these MOSFETs Q3, Q4 and Q5 are turned off and no leak current flows in this operational amplifier circuit.

Forming the operational amplifier circuit using low-threshold-voltage MOSFETs offers the advantages of being able to improve the CMIVR characteristic and lower the lower-limit operation voltage of the semiconductor integrated circuit device including the reference voltage generating circuit and the trimming circuit.

Figure 6:
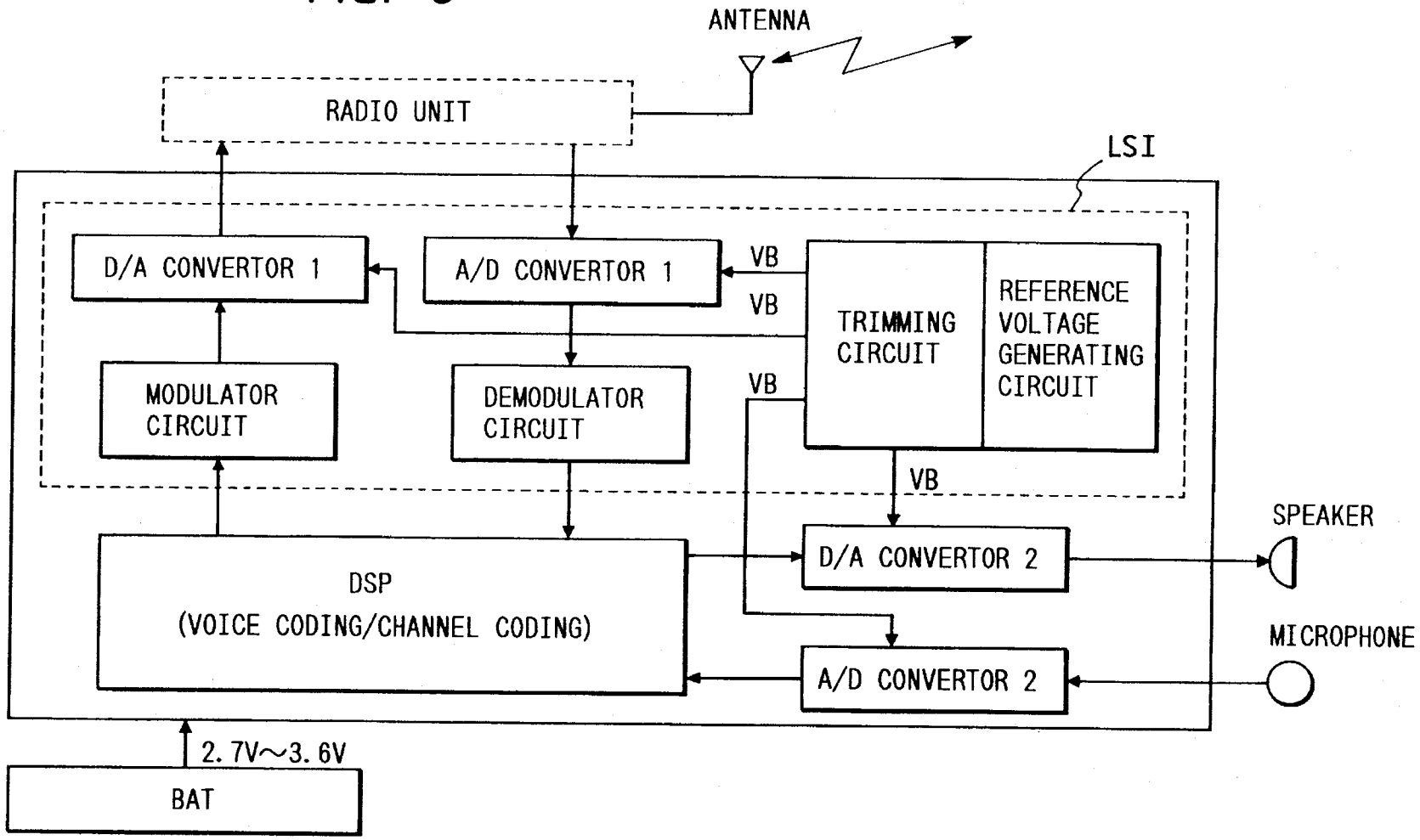
FIG. 6 is a block diagram showing one embodiment of a mobile communications terminal equipment that applies the present invention.

FIG. 6 shows a block diagram of a semiconductor integrated circuit device for mobile communications terminal equipment that applies the present invention.

In the figure, a section enclosed by a dotted line represents a semiconductor integrated circuit device including the reference voltage generating circuit of this invention. A voice and channel coding unit using a digital signal processor, a digital/analog convertor 2 for driving a speaker, and an analog/digital convertor 2 for receiving signals from microphone are each formed by using existing semiconductor integrated circuit devices.

The reference voltage generating circuit and the trimming circuit according to this invention are mounted on the semiconductor LSI, which includes a modulation circuit for modulating transmission signals formed by the voice and channel coding unit (digital signal processor), a D/A convertor 1 for converting the modulated signal to an analog signal and sending it to the radio unit, an A/D convertor 1 for converting a signal received from the radio unit into a digital signal, and a demodulating circuit for demodulating the digital signal and feeding it to the digital signal processor.

The mobile communications terminal equipment of this embodiment is portable and thus driven by a battery BAT, which may be the above-mentioned nickel-cadmium battery. The voltage of the nickel-cadmium battery decreases from 3.6 V to 2.7 V as the battery wears. To allow the semiconductor LSI device including analog circuits to operate without degrading its characteristics in such a relatively wide voltage range, the reference voltage generating circuit and trimming circuit employ MOSFETs with low threshold voltages.

Because of these demands on lower-limit operation voltages and amplification characteristics, MOSFETs are required to have low threshold voltages. In the reference voltage generating circuit of this invention, therefore, the low-threshold-voltage MOSFETs are formed not just for generating the reference voltages. Hence it is seen that the reference voltage generating circuit of this invention has a configuration suited for application to the semiconductor integrated circuit device that contains a combination of analog circuits and digital circuits.

The advantages of the above embodiments may be summarized as follows.

(1) A constant current is formed by a first MOSFET of depletion type whose source and gate are interconnected. The constant current is then passed through a current mirror circuit made up of MOSFETs of opposite conduction type with respect to the first MOSFET and to a second MOSFET which is of the same conduction type as the first MOSFET and whose gate and drain are interconnected. The voltage between the gate and source of the second MOSFET is used as an output constant voltage. The output constant voltage is compensated for temperature by the current ratio of the current mirror circuit. In this way, it is possible to produce a temperature-compensated reference voltage by a very simple circuit.

(2) The second MOSFET and the current mirror circuit MOSFETs can be made to lower their lower-limit operation voltages by setting the threshold voltages lower than those of other MOSFETs of the similar conduction types.

(3) The first and second MOSFETs are both introduced with an impurity concentration of a conduction type opposite to the substrate by ion-implanting the impurity into the substrate surface below the gate electrodes so that the first and second MOSFETs will have low threshold voltages. Then, additional impurity concentration is introduced into the first MOSFET to transform it into a depletion type MOSFET. This procedure minimizes process variations of the reference voltage.

(4) The sources of the first and second MOSFETs are set to the ground potential of the circuit. Between the drain of the first MOSFET and the current mirror circuit is provided a cascode MOSFET that receives at its gate a constant voltage which is based on the ground potential of the circuit. Between the drain of the second MOSFET and the current mirror circuit is provide another cascode MOSFET which receives at its gate a constant voltage produced based on a power supply voltage. This configuration improves the power supply removal ratio (PSRR).

(5) A trimming circuit is provided which utilizes a variable gain amplifier circuit whose gain is set by a control signal of multiple bits, which are formed by a program element enabled to be written after the probing process. With the trimming circuit, it is possible to produce a reference voltage of a desired value which is compensated for process variations.

(6) The reference voltage generating circuit is formed in the same semiconductor integrated circuit device that includes a circuit for performing digital/analog conversion or analog/digital conversion according to the reference voltage formed by the reference voltage generating circuit and a digital circuit that transfers digital signals to and from these circuits. Using MOSFETs with low threshold voltages in a circuit handling analog signals improves characteristics of the analog circuit. The reference voltage generating circuit thus can utilize the improved characteristics of the analog circuit.

The invention has been described in conjunction with the above example embodiments and it should be noted that the invention is not limited to these embodiments and that various modifications may be made without departing from the spirit of the invention. For example, in FIG. 1, the p-channel MOSFETS Q1 and Q2 may have standard threshold voltages. When an n-type substrate is employed as a semiconductor substrate, the back gate of the p-channel MOSFET may be connected to the power supply voltage VDD and those of the n-channel MOSFETs Q5, Q7 to the source potential. The MOSFETs with low threshold voltages in these circuits may be manufactured in various other ways than that shown in the embodiment of FIG. 2.

The fuse circuit of FIG. 5 may use an electrically programmable nonvolatile memory such as EPROM. Such an EPROM provides good matching with the p-type substrate. Hence, the semiconductor integrated circuit device mounted with the reference voltage generating circuit of this invention should preferably employ an EPROM or EEPROM as a nonvolatile memory circuit.

This invention can be applied widely to any reference voltage generating circuit incorporated into semiconductor integrated circuit devices which is formed of MOSFETs.

Representative advantages and effects of this invention may be briefly summarized as follows. A constant current is produced by a first MOSFET of depletion type whose source and gate are interconnected, and then is passed through a current mirror circuit made up of MOSFETs of opposite conduction type with respect to the first MOSFET and to a second MOSFET which has the same conduction type as the first MOSFET and whose gate and drain are interconnected. The voltage between the gate and the source of the second MOSFET is taken as an output constant voltage, which is temperature-compensated by the current ratio of the current mirror circuit. In this way, the temperature-compensated reference voltage can be produced by such a very simple circuit.

I claim:

1. A reference voltage generating circuit comprising:

a first MOSFET whose source and gate are interconnected to produce a constant current;

a current mirror circuit made up of MOSFETs of an opposite conduction type with respect to the first MOSFET, the current mirror circuit receiving the constant current produced by the first MOSFET; and a second MOSFET having the same conduction type as the first MOSFET and having the gate and drain thereof interconnected, the second MOSFET receiving an output current from the current mirror circuit;

wherein a voltage between the gate and the source of the second MOSFET is an output constant voltage;

whereby the current mirror circuit temperature-compensates the output constant voltage.

2. A reference voltage generating circuit according to claim 1, wherein the first and second MOSFETs and the MOSFETs making up the current mirror circuit are formed by introducing into the surface of a substrate below gate electrodes of the second MOSFET and the current mirror circuit MOSFETs an impurity of a conduction type opposite to that of the substrate so that the thresholds of the MOSFETs become lower than before the impurity was introduced.

3. A reference voltage generating circuit according to claim 2, wherein the first MOSFET is transformed into a depletion type MOSFET by introducing once again an impurity of a conduction type opposite to that of the substrate into the surface of the substrate below the gate electrode of the first MOSFET.

4. A reference voltage generating circuit according to claim 3, wherein the first and second MOSFETs are connected to a ground potential of the reference voltage generating circuit.

5. A reference voltage generating circuit according to claim 4, further comprising:

a third MOSFET provided between the drain of the first MOSFET and the current mirror circuit, the third MOSFET having the same conduction type as the second MOSFET and receiving at its gate a constant voltage produced based on the ground potential of the reference voltage generating circuit; and a fourth MOSFET provided between the drain of the second MOSFET and the current mirror circuit, the fourth MOSFET having the opposite conduction type with respect to the second MOSFET and receiving at its gate a constant voltage produced based on a power supply voltage of the reference voltage generating circuit.

6. A reference voltage generating circuit according to claim 5, wherein the output constant voltage is output through a variable gain amplification circuit whose gain is set by a control signal formed by a program element that is enabled to be written.

7. A reference voltage generating circuit according to claim 6, wherein the MOSFETs making up the variable gain amplification circuit include low-threshold MOSFETs, which are formed by introducing an impurity of the opposite conduction type with respect to the substrate into the substrate surface below the gate electrodes of the MOSFETs so that the thresholds of the MOSFETs are lower than before the impurity was introduced.

8. A reference voltage generating circuit according to claim 7, wherein the reference voltage generating circuit is formed in the same semiconductor integrated circuit device that includes a circuit which performs digital/analog conversion or analog/digital conversion according to the output constant voltage produced by the reference voltage generating circuit and a digital circuit which processes digital signals transferred to and from the digital/analog or analog/digital conversion circuit.

9. A reference voltage generating circuit according to claim 8, wherein a circuit formed in the semiconductor integrated circuit device for processing analog signals includes the low-threshold MOSFETs.

10. A reference voltage generating circuit according to claim 9, wherein the semiconductor integrated circuit device operates on a low-potential battery.

* * * * *